US005598941A

United States Patent [19]

Semersky et al.

[11] Patent Number: 5,598,941

[45] Date of Patent: Feb. 4, 1997

[54] GRIP PANEL STRUCTURE FOR HIGH-SPEED HOT-FILLABLE BLOW-MOLDED CONTAINER

[75] Inventors: Frank E. Semersky, Toledo, Ohio; John W. Tobias, Lancaster, Pa.

[73] Assignee: Graham Packaging Corporation, York, Pa.

[21] Appl. No.: 512,532

[22] Filed: Aug. 8, 1995

[51] Int. Cl.[6] ..... B65D 23/00; B65D 23/10

[52] U.S. Cl. ..... 215/384; 215/371; 215/382; 220/608; 220/675; 220/771

[58] Field of Search ..... 215/382, 383, 215/384, 371; 220/675, 604, 608, 669, 771; D9/530, 537

[56] References Cited

U.S. PATENT DOCUMENTS

| | | | |
|---|---|---|---|
| D. 231,904 | 6/1974 | Boden . | |
| D. 262,267 | 12/1981 | Cox | D9/383 |
| D. 277,551 | 2/1985 | Kerr | D9/367 |
| D. 279,167 | 6/1985 | Haney et al. | 215/384 X |
| D. 281,577 | 12/1985 | Larson et al. | 215/384 X |
| D. 282,349 | 1/1986 | Larson et al. | 215/384 X |
| D. 318,798 | 8/1991 | Biesecker | D9/378 |
| D. 344,457 | 2/1994 | Prevot et al. | D9/537 |
| 4,804,097 | 2/1989 | Alberghini et al. | 215/384 |
| 4,890,752 | 1/1990 | Ota et al. | 215/384 |
| 4,993,565 | 2/1991 | Ota et al. | 215/384 |
| 5,141,120 | 8/1992 | Brown et al. | 215/384 |
| 5,141,121 | 8/1992 | Brown et al. | 215/384 |
| 5,148,930 | 9/1992 | Ota et al. | 215/384 |
| 5,165,557 | 11/1992 | Ota et al. | 215/384 |
| 5,199,587 | 4/1993 | Ota et al. | 215/384 |
| 5,226,550 | 7/1993 | Mikolaitis et al. | 215/384 |
| 5,392,937 | 2/1995 | Prevot et al. | 215/384 |
| 5,472,105 | 12/1995 | Krishnakumar et al. | 215/384 |

*Primary Examiner*—Allan N. Shoap
*Assistant Examiner*—Niki M. Kopsidas
*Attorney, Agent, or Firm*—Howson and Howson

[57] ABSTRACT

A hot-fillable, blow-molded container has a grip panel structure which resists inverting when the container is filled with a hot liquid and after the container has been capped. The container and grip panel structure retain their aesthetic appearance and their structural integrity through use by the consumer.

3 Claims, 3 Drawing Sheets

GRIP PANEL STRUCTURE FOR HIGH-SPEED HOT-FILLABLE BLOW-MOLDED CONTAINER

FIELD OF THE INVENTION

The present invention relates to a hot-fillable blow-molded plastic container capable of accommodating reductions in volume due to cooling of a liquid hot-filled into the container and subsequently cooled, and particularly to a grip panel structure which resists deformation.

BACKGROUND OF THE INVENTION

The use of blow-molded plastic containers has become commonplace in packaging beverages, such as juice. Blow-molded PET plastic containers are particularly useful in the so-called hot-fill process, i.e. filling the containers with beverages at an elevated temperature, sealing the containers, and then allowing the beverage to cool in the sealed container. Blow-molded PET plastic containers can provide a package with sufficient flexure to compensate for the changes of pressure and temperature, while maintaining structural integrity and aesthetic appearance. In addition, the plastic used in the containers is recyclable. Production of such containers can be achieved efficiently, quickly, and at a minimum of cost.

The major problem associated with hot-fillable blow-molded containers is the need to accommodate changes in the container configuration due to reductions in volume as the hot-filled liquid cools after the container has been capped. Prior art approaches to solving this problem involve the use of flex panels at various locations in the container sidewall. Flex panels are designed to move in response to reductions in volume in the containers.

It has also become known in the art to form grip panel structures within the flex panels. The grip panel structures provide easy container handling by a user, since they provide a place for a person's thumb and fingers to be received on opposite sides of the container when the person's palm engages a rear portion of the container. An example of a container having a grip panel within a flex panel is shown in U.S. Pat. No. 5,392,937, issued to the assignee of the present application.

It has been found, in practice, that the grip panels tend to distort under certain conditions encountered during the hot-fill process. For instance, tests have shown that during high-speed hot-fill of a 64 ounce blow-molded PET plastic container at a liquid temperature of 187° F., and at flow rates in a range of 100 to 150 gpm (gallons per minute) the container must withstand a 4–6 psi (pounds per square inch) internal pressure for a brief period of time. The internal pressure acts on the grip panels, which are normally recessed into the container, and causes them to distort, e.g. bow outwardly from the container. Since the molecular structure of the plastic container is altered by changes in temperature and pressure, the grip panel cannot thereafter return to its initial designed state. This is unintended and is aesthetically undesirable.

Although the referenced patented container can function satisfactorily for its intended purpose under certain hot-fill conditions, there is a need for a blow-molded, grip-paneled plastic container which resists distortion of its inwardly recessed grip panels during high-speed hot-fill conditions.

OBJECTS OF THE INVENTION

With the foregoing in mind, a primary object of the present invention is to provide an improved hot-fillable, blow-molded plastic container having a grip panel structure capable of retaining its structural integrity during high-speed, hot-fill processing.

Another object of the present invention is to provide a hot-fillable, blow-molded plastic container having novel hand grips which resist distortion under high-speed hot-fill process conditions.

A further object of the present invention is to provide an improved hot-fillable, blow-molded plastic container which utilizes a minimum of plastic and retains its structural integrity under various hot-fill process conditions.

SUMMARY OF THE INVENTION

More specifically, the present invention provides a hot-fillable, blow-molded plastic container particularly suited for containing a liquid filled initially in a hot state and subsequently sealed so that the cooling of the liquid creates a reduced volume of the liquid in the container. The container includes a bottom portion, a shoulder portion above the bottom portion, a closable neck portion on the shoulder portion permitting filling and discharge of the liquid, and a body portion connecting the bottom and shoulder portions. The body portion has an arcuate front panel which extends between the bottom and shoulder portions, and an arcuate rear panel located diametrically opposite the front panel and extending between the bottom and shoulder portions. The body portion also has a pair of flex panels which are set inwardly from and extend between the shoulder and bottom portions on opposite sides of the container. The flex panels extend between the front and rear panels, and each flex panel has formed therein an inwardly recessed rigid grip panel for receiving a person's thumb and fingers on opposite sides of the container when the rear panel is engaged by a person's palm.

The improvement comprises an elongate rib which extends along the inwardmost recessed edge of each grip panel and which cooperates with an angulated grip surface and transitional wall section to prevent distortion of the grip panel during the hot-fill process. To this end, the grip panel comprises a grip surface extending from the rear panel and recessed into the container. A continuous, narrow transitional wall section connects the remaining periphery of the grip surface to the flex panel. The transitional wall section remote from the rear panel intersects the grip surface at an included angle equal to or less than 120°. The combination of the rib and the angle of interconnection prevents the grip panel from distorting during high-speed hot-filling.

BRIEF DESCRIPTION OF THE DRAWINGS

These and other objects, features and advantages of the present invention should become apparent from the following description when taken in conjunction with the accompanying drawings, in which.

DESCRIPTION OF THE PREFERRED EMBODIMENT

Figure 1:
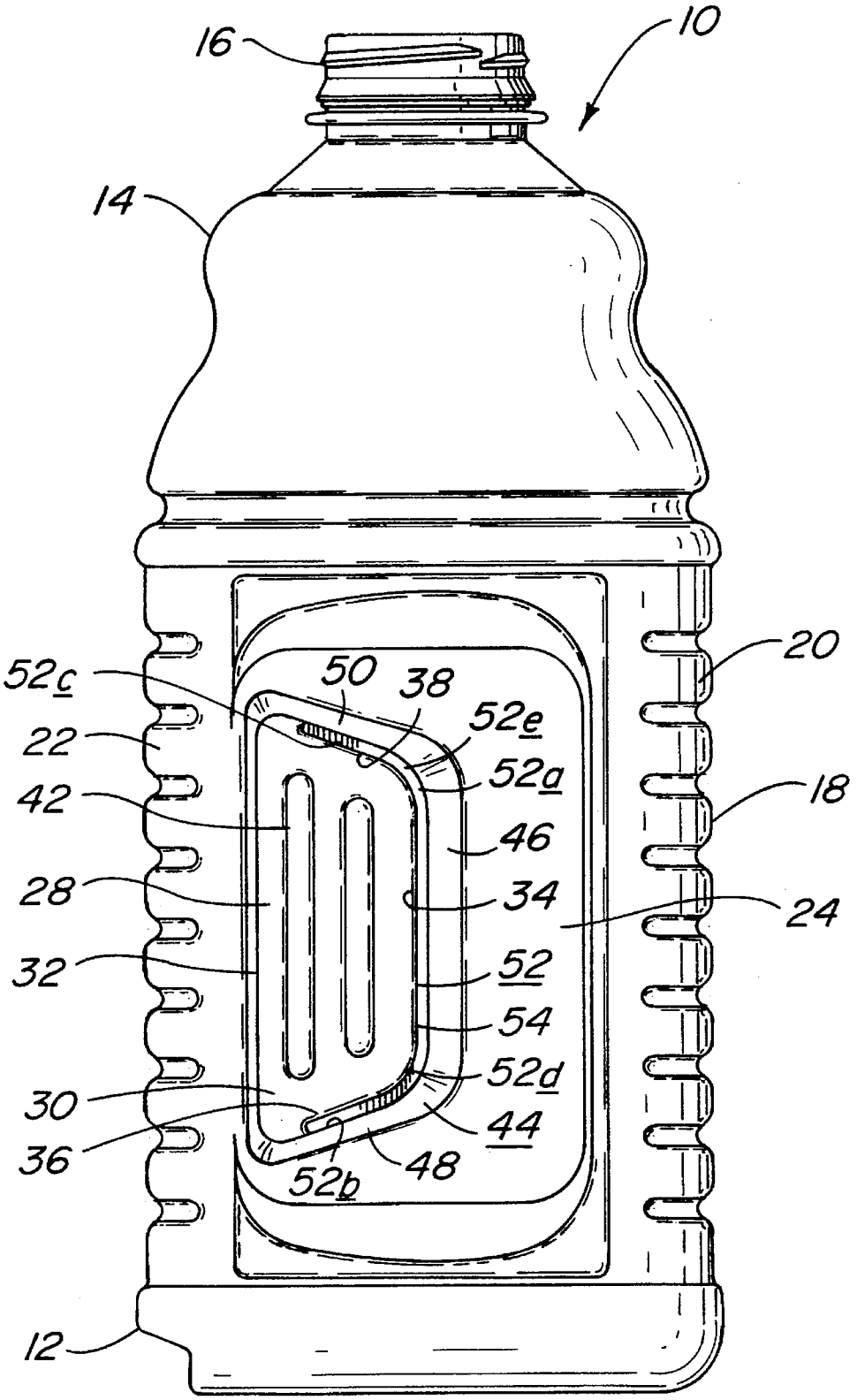
FIG. 1 illustrates a side elevational view of a hot-fillable, blow-molded plastic container embodying the present invention.
Figure 2:
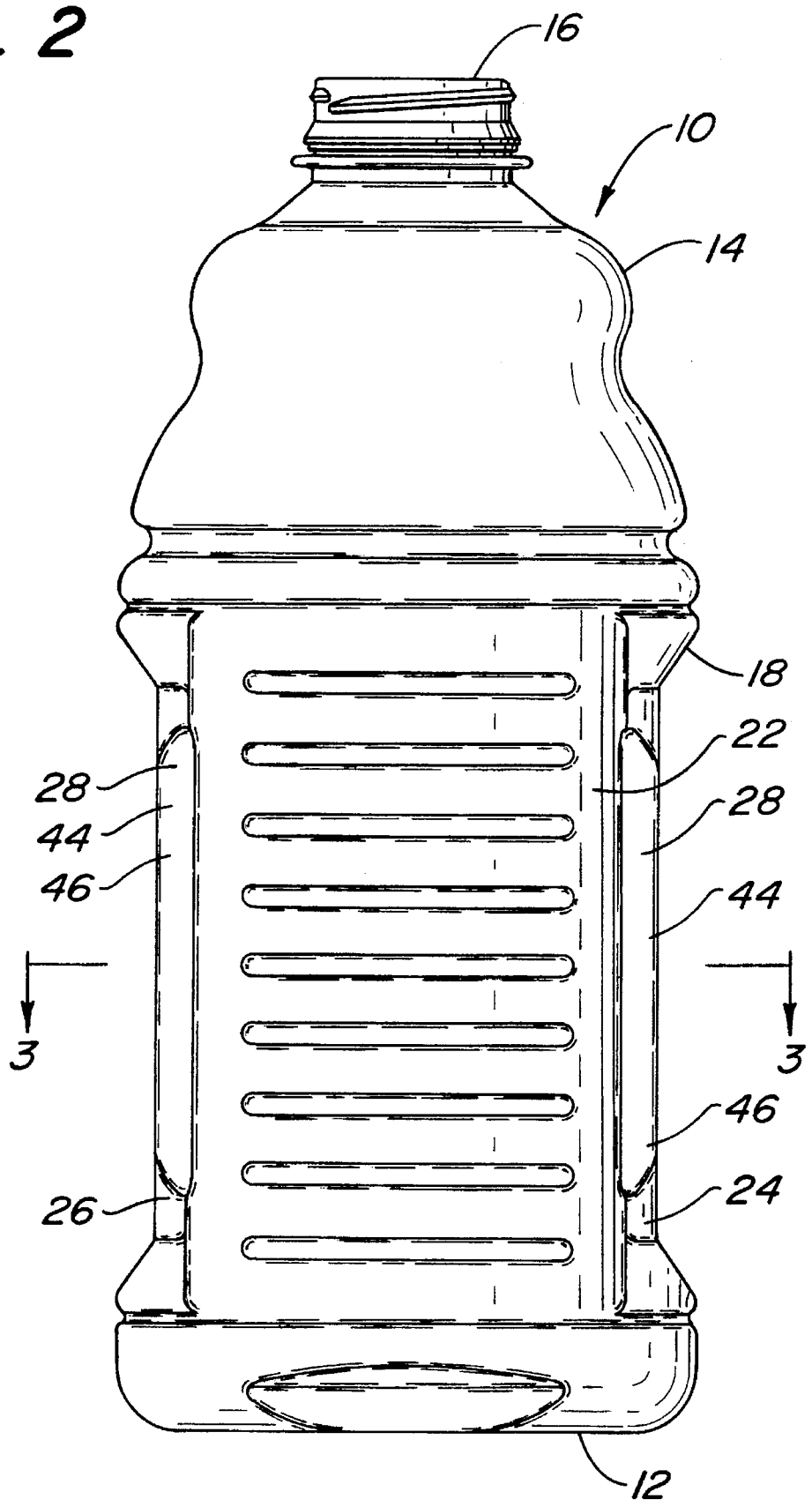
FIG. 2 illustrates a rear elevational view of the container.
Figure 3:
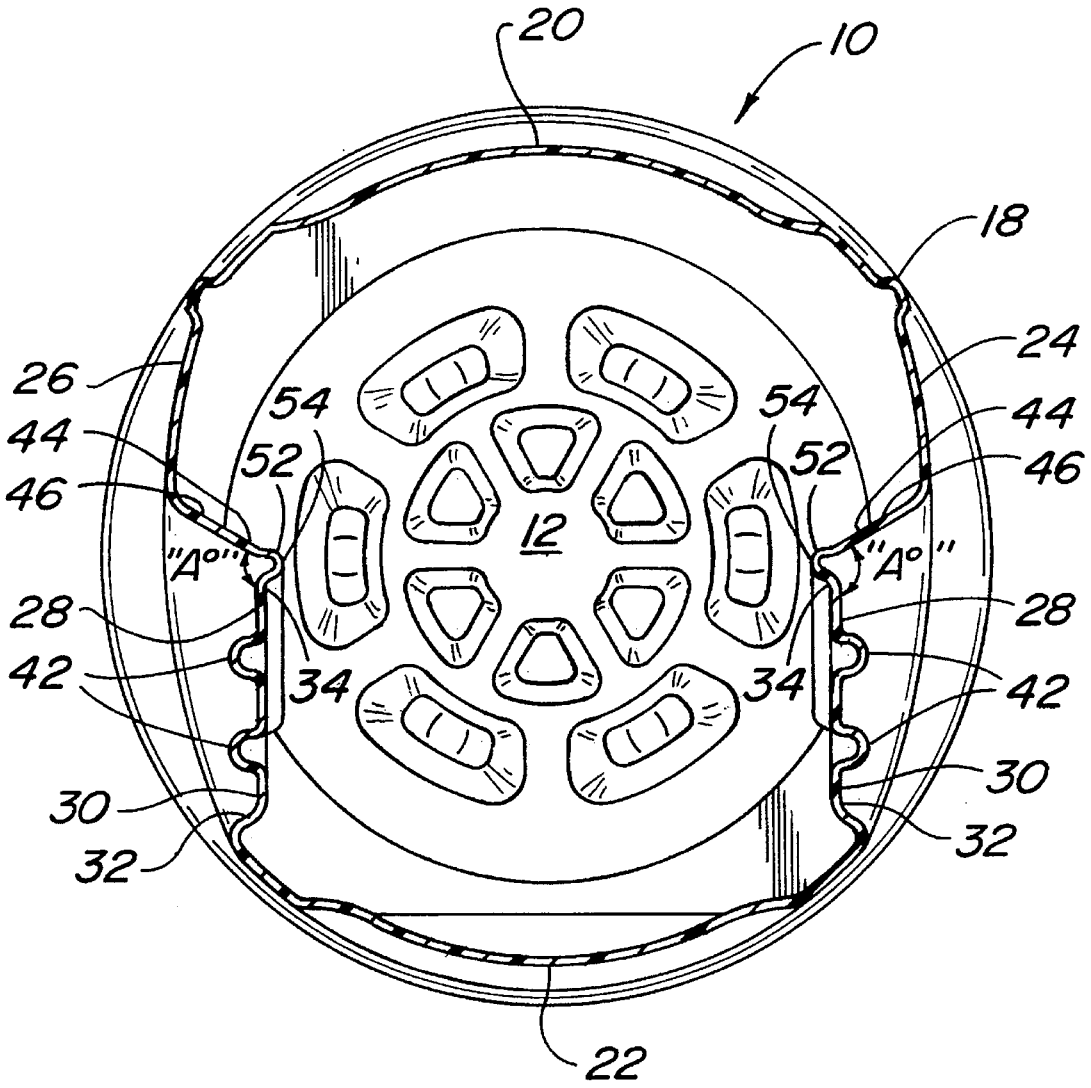
FIG. 3 is an enlarged cross-sectional view taken on line 3—3 of FIG. 2.

Referring now to the drawings, FIG. 1 illustrates a hot-fillable, blow-molded plastic container 10 which embodies the present invention. The container is designed to be filled with a liquid initially in a hot state and subsequently sealed, and cooled. Such a process is intended to be accomplished at high speed with automated equipment.

In the hot-fill process the liquid is normally heated to temperatures of about 185° F. and is flowed into open containers at high speed rates on the order of 100 to 150 gpm. The high speed fill rates cause an internal pressure to act momentarily (3–6 seconds) on the container sidewall, and can cause container sidewall deformation. These pressures can come from the pressure head exerted by an overhead filler bowl or from a mechanical pump flowing the liquid from a lower-level source. In addition, the heat of the liquid affects the molecular structure of the sidewalls and can cause permanent deformation.

As previously discussed, various container designs with grip panels, including applicant's patented design, have been proposed to accommodate the reduction in volume in a manner which retains the aesthetics of the container and which can withstand the stresses involved in hot-filling the containers. While applicant's patented design has met with success under certain hot-fill process conditions, there are certain high-speed conditions that create problems that need to be solved in order for the container to be fully satisfactory over a range of hot-fill processing conditions.

The present invention overcomes the limitations of the prior art containers by means of a novel grip panel structure which resists distortion of the grip panel during high-speed hot-filling.

To this end, the container 10 has a bottom portion 12, a shoulder portion 14 and a neck 16. As shown in the drawings, the bottom portion 12 and shoulder portion 14 have similar cross-sections which are aligned vertically. The neck 16 is threaded and is connected to the shoulder portion 14 by a domed wall. A cap (not shown) closes the neck 16 to seal the container 10.

The container 10 has a body portion 18 which extends between and connects the bottom and shoulder portions, 12 and 14. The body portion 18 comprises an arcuate front panel 20 which extends vertically between the bottom and shoulder portions, 12 and 14. A label (not shown) is adapted to be affixed to the front panel 20 by conventional means, such as an adhesive.

The body portion 18 of the container 10 also has an arcuate rear panel 22 which is located diametrically opposite the front panel 20. The rear panel 22 as shown is of lesser arcuate extent than the front panel 20 and extends vertically between the bottom and shoulder portions, 12 and 14.

The body portion 18 also has a pair of flex panels 24 and 26 extending between the front panel 20 and the rear panel 22 on diametrically opposite sides of the container 10. The flex panels 24 and 26 are both inset inwardly from the shoulder and bottom portions, 12 and 14. Each flex panel 24 and 26 as shown has a rectangular elevational configuration with its lengthwise dimension being disposed vertically.

Each flex panel 24 and 26 has a rigid inwardly recessed grip panel structure 28. When a person engages the rear panel 22 with their palm, the rigidly inwardly recessed grip panels 28 are structured to receive the person's thumb and fingers on opposite sides of the container 10 to allow the container 10 to be easily handled by the user.

The novel portion of the container 10 is found in the structure of each grip panel 28.

As shown in the drawings, each grip panel 28 has a grip surface 30 of generally trapezoidal shape. The trapezoidal shaped grip surface 30 is defined by an elongate vertically-disposed base, or long edge, 32, an inset shorter parallel peripheral edge 34, and a pair of inwardly converging side legs, or edges, 36 and 38. The elongate base edge 32 is disposed vertically along and merges with the rear panel 22. Preferably, the grip surface 30 has a pair of outwardly-convex reinforcing ribs 42 disposed vertically in spaced parallel relation between spaced parallel coplanar surface portions in the grip surface 30 to enhance gripability and to stiffen the grip surface 30 against undesirable flexure about a horizontal axis.

The grip surface 30 is connected to the flex panel 24 by a continuous narrow transitional wall section 44. To this end, each grip panel 28 has a lower sidewall section 48 connecting the lower side edge 36 of the grip surface 30 to the flex panel 24 and an upper sidewall section 50 connecting the upper side edge 38 of the grip surface 30 to the flex panel 24. The shorter vertical edge 34 between the proximal portions of the upper and lower side edges 36 and 38 is connected to the flex panel 24 by a vertically disposed wall 46 that extends into the container.

Under the pressure of liquid flow during high speed filling of the container, sufficient force is exerted on each grip structure 28 as can cause undesirable distortion of the recessed grip structures 28. To prevent such distortion, an elongate rib, or bead, 52 is provided around a specific peripheral portion of each grip panel 28. As shown in the drawings, the bead 52 has a vertical section **52*a* located on an inwardly most recessed edge 54 of the grip panel 28 where the short edge 34 of the grip surface 30 intersects with the inturned transitional wall section 46. As shown, the elongate bead 52 also has horizontally-divergent sections 52*b* and 52*c* that extend along a major portion of both side edges 36 and 38 of the grip surface 30 and that are connected to the vertical section 52*a* by arcuate, or curved, sections 52*d* and 52*e*. As best seen in FIG. 1, the bead 52 is continuous and has a U-shaped cross-section that extends inwardly into the container 10 from the plane of the grip surface 30**.

It has been determined that the angle "A" with which the grip surface 30 intersects the inclined sidewall section 46 also has a significant affect on the flexural stiffness of the grip panel 28 during high speed hot-filling. The angle A should be equal to or less than 120°. Through testing, it has been determined that an angle "A" of greater than 120° is undesirable since it can allow the grip structure 28 to bow outward into an unwanted condition.

Tests have shown that for a 64 ounce container filled with a liquid at a temperature of approximately 185° F. at a rate of 125 gallons per minute, the internal pressure of the fluid against the grip panel was measured at 4–6 psi. However, despite these high temperatures, flow rates, and pressures, the panel structure of the present invention was able to resist unwanted distortion. Thus, it has been determined that the combination of the described continuous elongate bead 52 and angle "A" of 120°, or less, prevents the grip panel 28 from distorting.

While a preferred embodiment of the present invention has been described in detail, various modifications, alterations and changes may be made without departing from the spirit and scope of the present invention as defined in the appended claims.

We claim:

1. In a hot-fillable, blow-molded plastic container for containing a liquid filled initially in a hot state and subsequently sealed so that the cooling of the liquid creates a reduced volume in the container having a bottom portion, a shoulder portion above the bottom portion, a closable neck portion on the shoulder portion permitting filling and discharge of the liquid, and a body portion connecting the bottom and shoulder portions, the body portion having an arcuate front panel extending between the bottom and shoulder portions and an arcuate rear panel located diametrically opposite the front panel and extending between the bottom and shoulder portions, the body portion having a pair of flex panels set inwardly from and extending between the shoulder and bottom portions on opposite sides of the container, the flex panels extending between the front and rear panels and each flex panel having formed therein an inwardly recessed rigid grip panel for receiving a person's thumb and fingers on opposite sides of the container when the rear panel is engaged by a person's palm, the improvement wherein each of the grip panels has an elongate rib along an inwardly most recessed edge of each of the grip panels to prevent inverting of the grip panels, each of the grip panels having a planar grip surface defined by a plurality of coplanar flat portions, and a continuous narrow transitional wall section extending around said planar grip surface away from the rear panel, said planar grip surface intersecting said transitional wall section at an included obtuse angle of up to about 120°, said rib extending inwardly into the interior of the container and out of the plane of the planar grip panel and being located at the intersection of said planar grip panel and said transitional wall section, whereby the container grip panel maintains its structural integrity against everting during hot-filling and after being cooled, and later opened.

2. In a hot-fillable, blow-molded plastic container for containing a liquid filled initially in a hot state and subsequently sealed so that cooling of the liquid creates a reduced volume in the container, the container having a bottom portion, a shoulder portion, closeable neck portion on the shoulder portion permitting filling and discharge of the shoulder portion permitting filling and discharge of the liquid, and a body portion connecting the bottom portion and the shoulder portion, the body portion having an arcuate front panel extending between the bottom and shoulder portions, the body portion having an arcuate rear panel located diametrically opposite the front panel and extending between the bottom and shoulder portions, and the body portion having a pair of flex panels set inwardly from and extending between the shoulder and bottom portions on opposite sides of the container, the flex panels extending between the front panel and the rear panel and each having formed therein a rigid grip structure, the improvement wherein said grip structure comprises:

a grip surface extending from a portion of a peripheral side edge of said rear panel and projecting inwardly into said container said grip surface having a plurality of coplanar flat portions and being trapezoidal in shape with an elongate, vertically-disposed base edge adjacent said rear panel, an inset shorter parallel peripheral edge, and a pair of inwardly converging side legs;

a continuous, narrow transitional wall section connecting said flex panel to a peripheral edge of said planar grip surface remote from said rear panel, said transitional wall section intersecting said grip surface at an included obtuse angle of up to about 120°; and a U-shaped bead extending inwardly into the interior of the container and out of the plane of said grip panel along said peripheral edge of said grip surface where it intersects said transitional wall section for resisting everting of the grip structure, said bead extending continually along said shorter panel edge and a portion of both said side legs of said grip surface.

3. In a hot-fillable, blow-molded plastic container for containing a liquid filled initially in a hot state and subsequently sealed so that cooling of the liquid creates a reduced volume in the container, the container having a bottom portion, a shoulder portion, a closable neck portion on the shoulder portion permitting filling and discharge of the liquid and a body portion connecting the bottom and shoulder portions, the body portion having an arcuate front panel extending between the bottom and shoulder portions, the body portion having an arcuate rear panel located diametrically opposite the front panel and extending between the bottom and shoulder portions, the body portion having a pair of flex panels set inwardly from and extending between the shoulder and bottom portion on opposite sides of the container, the flex panels extending between the front panel and the rear panel and each flex panel having formed therein a rigid inwardly recessed grip structure, the improvement wherein said grip structure comprises:

a planar grip surface extending from the rear panel and being inwardly recessed into the container, said planar grip surface having a plurality of coplanar flat portions interrupted by spaced parallel reinforcing ribs;

a continuous, narrow transitional wall section extending from the flex panel toward a peripheral edge of said grip surface; and a bead for preventing inverting of the inwardly recessed grip structure, said bead connecting said peripheral edge of said grip surface to a peripheral edge of said transitional wall section, said bead being hollow and having a U-shaped cross-section extending out of the plane of said grip panel and in a direction into said container, said bead extending continuously at the intersection of said grip panel and said transitional wall; and said planar grip surface and said transitional-wall section extending from said bead at an obtuse angle therebetween of up to about 120°, said bead and said angle cooperating to prevent everting of the grip structure during application of an internal container pressure of about 4 to 6 pounds per square inch during high-speed filling with a liquid at a temperature of at least about 185° fahrenheit.

* * * * *